US011283159B2

(12) United States Patent
Zhao et al.

(10) Patent No.: US 11,283,159 B2
(45) Date of Patent: Mar. 22, 2022

(54) ARCH STRUCTURE FOR MULTI-BAND BASE STATION ANTENNA

(71) Applicant: Nokia Shanghai Bell Co., Ltd., Shanghai (CN)

(72) Inventors: Bo Zhao, Shanghai (CN); Jie Zhou, Shanghai (CN); Jianhong Chen, Shanghai (CN); Chang Wang, Shanghai (CN)

(73) Assignee: Nokia Shanghai Bell Co., Ltd., Shanghai (CN)

( * ) Notice: Subject to any disclaimer, the term of this patent is extended or adjusted under 35 U.S.C. 154(b) by 83 days.

(21) Appl. No.: 16/957,602

(22) PCT Filed: Dec. 26, 2017

(86) PCT No.: PCT/CN2017/118603
§ 371 (c)(1),
(2) Date: Jun. 24, 2020

(87) PCT Pub. No.: WO2019/127011
PCT Pub. Date: Jul. 4, 2019

(65) Prior Publication Data

US 2021/0057801 A1 Feb. 25, 2021

(51) Int. Cl.
*H01Q 1/12* (2006.01)
*H01Q 1/24* (2006.01)
(Continued)

(52) U.S. Cl.
CPC ..... *H01Q 1/246* (2013.01); *H01Q 5/307* (2015.01); *H01Q 1/1228* (2013.01);
(Continued)

(58) Field of Classification Search
CPC ..... H01Q 1/246; H01Q 5/307; H01Q 1/42; H01Q 1/1242; H01Q 12/28
See application file for complete search history.

(56) References Cited

U.S. PATENT DOCUMENTS

2020/0220251 A1* 7/2020 Ai ..... H01Q 1/246

FOREIGN PATENT DOCUMENTS

CN 2935504 Y 8/2007
CN 201584496 U 9/2010
(Continued)

OTHER PUBLICATIONS

English Bibliography of Chinese Application No. CN105591207A, Published May 18, 2016, Printed from Derwent Innovation on Oct. 22, 2021, 5 pages.

(Continued)

*Primary Examiner* — Joseph J Lauture
(74) *Attorney, Agent, or Firm* — Fay Sharpe LLP

(57) ABSTRACT

The present invention provides an arch structure for multi-band base station antenna, the arch structure comprises two interface units for connecting with the side edge of a reflector, and a plurality of snap-fits for fixing with the bottom of the reflector, wherein at least two snap-fits in the plurality of snap-fits are not arranged on a projection mid-axis of the arch structure. According to the arch structure of the present invention, it can effectively avoid the interference between the arch structure and the dipole or dipole isolation wall, and enhance the stability of arch structure, so that the width of the arch structure can be reduced and the manufacturing cost can be saved.

5 Claims, 5 Drawing Sheets

(51) Int. Cl.
*H01Q 5/307* (2015.01)
*H01Q 9/16* (2006.01)
*H01Q 1/42* (2006.01)

(52) U.S. Cl.
CPC ..... *H01Q 1/1242* (2013.01); *H01Q 1/42* (2013.01); *H01Q 1/427* (2013.01); *H01Q 9/16* (2013.01)

(56) References Cited

FOREIGN PATENT DOCUMENTS

| | | | |
|---|---|---|---|
| CN | 202523848 | U | 11/2012 |
| CN | 202817163 | U | 3/2013 |
| CN | 105591207 | A | 5/2016 |
| CN | 205231248 | U | 5/2016 |
| CN | 205960179 | U | 2/2017 |
| CN | 107293837 | A | 10/2017 |
| CN | 207611854 | U | 7/2018 |

OTHER PUBLICATIONS

English Bibliography of Chinese Application No. CN201584496U, Published Sep. 15, 2010, Printed from Derwent Innovation on Oct. 22, 2021, 5 pages.
English Bibliography of Chinese Application No. CN202817163U, Published on Mar. 20, 2013, Printed from Derwent Innovation on Oct. 22, 2021, 5 pages.
English Bibliography of Chinese Application No. CN205231248U, Published on May 11, 2016, Printed from Derwent Innovation on Oct. 22, 2021, 5 pages.
International Search Report for PCT/CN2017/118603 dated Sep. 13, 2018.
English Bibliography of Chinese Application No. CN2935504Y, Published on Aug. 15, 2007, Printed from Derwent Innovation on Nov. 18, 2020, 5 pages.
English Bibliography of Chinese Application No. CN107293837A, Published on Oct. 24, 2017, Printed from Derwent Innovation on Nov. 18, 2020, 5 pages.
English Bibliography of Chinese Application No. CN202523848U, Published on Nov. 7, 2012, Printed from Derwent Innovation on Nov. 18, 2020, 5 pages.
English Bibliography of Chinese Application No. CN205960179U, Published on Feb. 15, 2017, Printed from Derwent Innovation on Nov. 18, 2020, 5 page.
English Bibliography of Chinese Application No. CN207611854U, Published on Jul. 13, 2018, Printed from Derwent Innovation on Nov. 18, 2020, 5 pages.
Written Opinion of the International Searching Authority for PCT Application No. PCT/CN2017/118603, dated Sep. 13, 2018, 3 pages.

* cited by examiner

ARCH STRUCTURE FOR MULTI-BAND BASE STATION ANTENNA

FIELD OF THE INVENTION

The present invention relates to the field of antenna technology, and more specifically, to an arch structure for multi-band base station antenna.

BACKGROUND OF THE INVENTION

In the field of antenna technology, arch is a general part in Base Station Antenna (BSA) products, its main function is to support radome. In general, an arch is installed in a reflector to support radome to prevent antenna internal radiated parts from being damaged. In the prior art, the arch comprises a plurality of snap-fits for fixing with the bottom of the reflector, the plurality of snap-fits are arranged horizontally in a straight line (the straight line is considered as the medial axis of the projection of the arch on a horizontal plane which the plurality of snap-fits are located in, the straight line is defined as the "projection mid-axis" in here). In addition, the two sides of the arch are connected to the two side edges of the reflector via plastic rivet. FIG. 1 shows an assembly diagram of an arch and a reflector according to an example of the prior art, wherein, an arch 101 comprises four snap-fits 1011, which are arranged horizontally in a straight line, the two sides of the arch 101 are connected to the two side edges of the reflector 103 via plastic rivet 102.

The above solution in the prior art has the following defects:

1) During assembly, there need two extra rivets to connect the arch to both side edges of the reflector, which on the one hand increases the assembly time and labor costs, and on the other hand presents a risk in mass production lines.

2) In the multi-band base station antenna application, low/high band dipoles are stagger arrangement, as all snap-fits are arranged horizontally in a straight line, which can easily interfere with dipole or dipole isolation wall, as shown in FIG. 1, there is interference between the rightmost snap-fit 1011 and metal sheet 104.

3) The arch sway easily after installed on the reflector, it makes the arch less stable.

In view of the above defects, the following solutions exist in the prior art:

1) Fix the side edge of the reflector with clip instead of rivet. For example, FIG. 2-1 shows an assembly diagram of an arch and a reflector according to another example of the prior art, and FIG. 2-2 shows the partial cross-sectional view of FIG. 2-1, wherein, both sides of the arch have a clip 201, the side edge of the reflector has a through hole 202. During assembly, a clip 201 on one side of arch can be easily inserted into the corresponding through hole 202 directly, and a clip 201 on the other side of arch need to be pressed into the corresponding through holes 202. However, based on this solution, the clips are more likely to break, and the fit clearance between reflector and arch lead to the frequency of clip broken.

2) The arch is placed between two dipoles. But if there has small metal sheet part also need to place on the same location, it have to remove the arch or the metal sheet part to avoid interference, or remove the bottom support part from the arch to make the arch overpass the metal sheet part. However, if lacking of the support of reflector bottom surface, the arch will more easily shaking during wind load test.

SUMMARY OF THE INVENTION

An objective of the invention is to provide an optimized arch structure for multi-band base station antenna.

According to one aspect of the present invention, there is provided an arch structure for multi-band base station antenna, the arch structure comprises two interface units for connecting with the side edge of a reflector, and a plurality of snap-fits for fixing with the bottom of the reflector, wherein at least two snap-fits in the plurality of snap-fits are not arranged on a projection mid-axis of the arch structure.

Preferably, the number of the plurality of snap-fits is not less than 3, and the plurality of snap-fits are arranged in at least two straight lines.

As a preferred solution, the layout of the plurality of snap-fits is a triangular structure.

As another preferred solution, the number of the plurality of snap-fits is not less than 4, the layout of the plurality of snap-fits is a parallelogram or trapezoidal structure.

Preferably, the interface unit adopts an I-shaped structure, and the I-shaped structure matches the U-shaped groove on the side edge of the reflector.

According to another aspect of the present invention, there is provided an arch structure for multi-band base station antenna, the arch structure comprises two interface units for connecting with the side edge of a reflector, and a plurality of snap-fits for fixing with the bottom of the reflector, wherein the interface unit adopts I-shaped structure, and the I-shaped structure matches U-shaped groove on the side edge of the reflector.

Compared with the prior art, the present disclosure has the following advantages: it can effectively avoid the interference between the arch structure and the dipole or dipole isolation wall, and enhance the stability of arch structure since at least two snap-fits in the plurality of snap-fits are not arranged on the projection mid-axis of the arch structure. In addition, because of the enhanced stability of the arch structure, making it possible to reduce the width of the arch structure, and slender structure makes the product weight smaller, thereby reducing production materials and saving manufacturing costs. Taking an arch structure with four snap-fits as an example, compared with the prior art, the arch structure in this invention can save about 46% of the cost, the longer the antenna length is, the more arches are needed, thus the more cost can be saved. Moreover, it is easier to assemble in the mass production line by designing the interface unit of the arch structure as a I-shaped structure and designing the side edge of the reflector as a U-shaped groove that matches the I-shape structure, it does not need extra rivet to fix reflector, and can reduce assembly time, material cost and labor costs.

DESCRIPTION OF ACCOMPANIED DRAWINGS

Through reading the following detailed depiction on the non-limiting embodiments with reference to the accompanying drawings, the other features, objectives, and advantages of the present invention will become clearer.

FIG. 2-1 shows an assembly diagram of an arch and a reflector according to another example of the prior art;

FIG. 2-2 shows the partial cross-sectional view of FIG. 2-1;

Same or like reference numerals in the accompanying drawings indicate the same or corresponding components.

EMBODIMENT OF INVENTION

Figure 1:
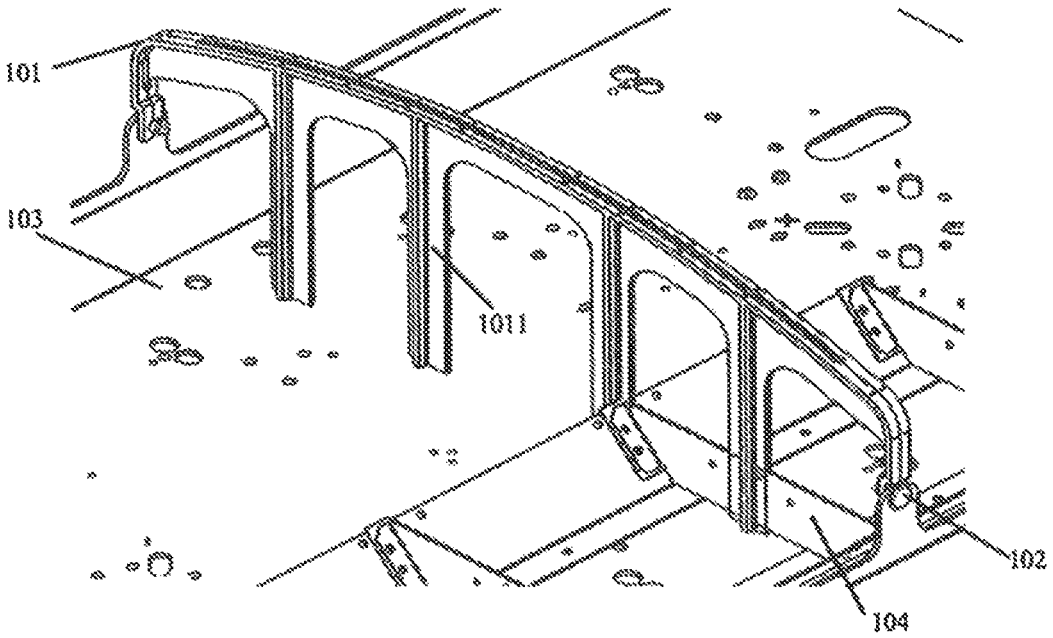
Fig. 1 (PRIOR ART)
FIG. 1 shows an assembly diagram of an arch and a reflector according to an example of the prior art.
Figures 1, 2:
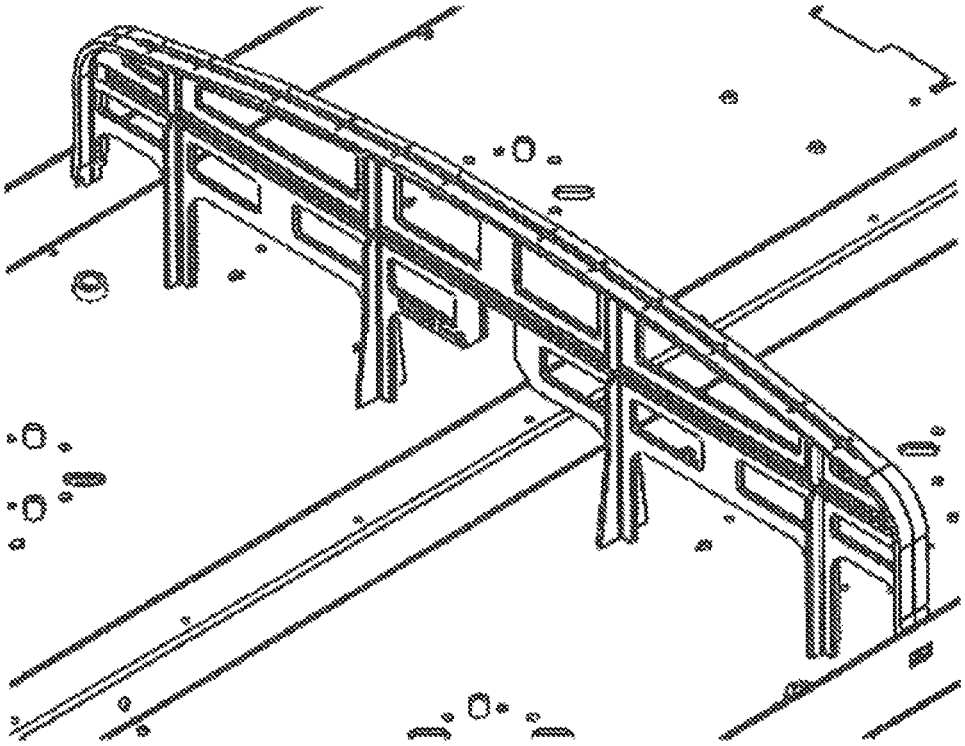
Fig. 2-1 (PRIOR ART)
Figure 2:
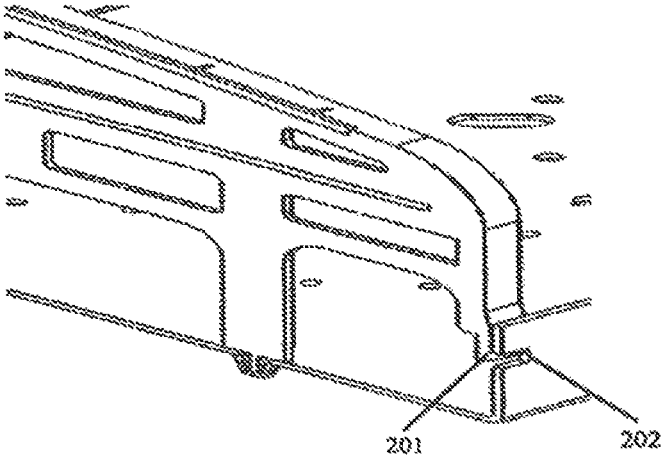
Fig. 2-2 (PRIOR ART)

Hereinafter, the present invention will be further described in detail with reference to the accompanying drawings.

The present invention provides an arch structure for multi-band base station antenna, the arch structure comprises two interface units for connecting with the side edge of a reflector, and a plurality of snap-fits for fixing with the bottom of the reflector, wherein at least two snap-fits in the plurality of snap-fits are not arranged on a projection mid-axis of the arch structure. The projection mid-axis represents the medial axis of the projection of the arch structure on a horizontal plane which the plurality of snap-fits are located in.

Wherein a snap-fit is not arranged on the projection mid-axis of the arch structure, indicating that the snap-fit is located outside the projection mid-axis.

As an example, the arch structure comprises two snap-fits, one snap-fit is located in front of the projection mid-axis and the other snap-fit is located behind the projection mid-axis, and the vertical distance from the two snap-fits to the projection mid-axis are equal.

As another example, the arch structure comprises three snap-fits, from left to right, the first snap-fit is located in front of the projection mid-axis, the second snap-fit is located on the projection mid-axis, and the third snap-fit is located behind the projection mid-axis, the three snap-fits are arranged in a straight line that intersects with the projection mid-axis.

Preferably, the number of the plurality of snap-fits is not less than 3, and the plurality of snap-fits are arranged in at least two straight lines.

As a preferred solution, the layout of the plurality of snap-fits is a triangular structure.

For example, an arch structure comprises three snap-fits, form left to right, the first snap-fit is located in front of the projection mid-axis, the second snap-fit is located behind the projection mid-axis, and the third snap-fit is located in front of the projection mid-axis, the three snap-fits are arranged in a triangular structure.

As another preferred solution, the number of the plurality of snap-fits is not less than 4, the layout of the plurality of snap-fits is a parallelogram or trapezoidal structure.

For example, an arch structure comprises four snap-fits, form left to right, the first snap-fit is located in front of the projection mid-axis, the second snap-fit is located behind the projection mid-axis, the third snap-fit is located in front of the projection mid-axis, and the fourth snap-fit is located behind the projection mid-axis. The four snap-fits are arranged in a parallelogram structure.

For another example, an arch structure comprises four snap-fits, form left to right, the first snap-fit is located in front of the projection mid-axis, the second snap-fit is located behind the projection mid-axis, the third snap-fit is located behind the projection mid-axis, and the fourth snap-fit is located in front of the projection mid-axis. The four snap-fits are arranged in a trapezoidal structure.

It should be noted that, when an arch structure comprises four snap-fits, and the four snap-fits are arranged in a parallelogram structure, since the arch structure is symmetrical, the installer does not need to consider the specific positions of each snap-fit and the direction of holding the arch structure. They can install the arch structure directly without errors in the installation direction, which makes the installation process more flexible, then can effectively save installation time and improve installation efficiency.

It should be noted that, the layout of the plurality of snap-fits is not limited to the triangular structure, parallelogram structure, and trapezoidal structure. Those skilled in the art should understand that, other possible layout solutions should also be included in the protection scope of the present application. For example, when an arch structure comprises 4 snap-fits, the 4 snap-fits may be arranged as an irregular quadrangle. For another example, an arch structure comprises 5 snap-fits, from left to right, the first and the fourth snap-fits are located in front of the projection mid-axis, the second and the fifth snap-fits are located behind the projection mid-axis, and the third snap-fit is located on the projection mid-axis, wherein the first, second, fourth and fifth snap-fits are arranged in a parallelogram structure.

Preferably, the interface unit adopts an I-shaped structure, and the I-shaped structure matches the U-shaped groove on the side edge of the reflector. Wherein the I-shaped structure includes a rib plate in the middle for inserting into the U-shaped groove, so that the arch structure can be fixedly connected to the side edge of the reflector. In the installation process, the rib plat play a guiding role, and after the installation is completed, it can avoid the sloshing of the interface unit in the U-shaped groove, and the interface unit will not be disengaged.

Figure 3:
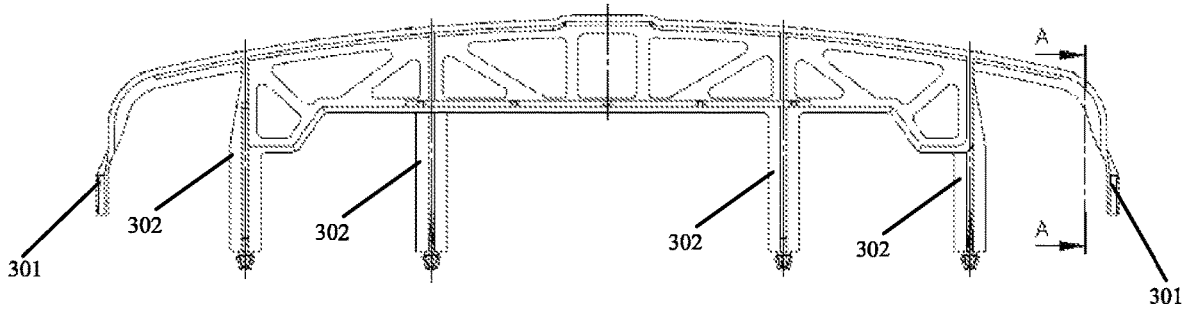
FIG. 3 shows a schematic diagram of an arch structure according to a preferred embodiment of the present invention.
Figure 4:
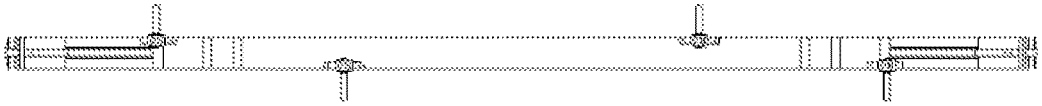
FIG. 4 shows a bottom view of the arch structure shown in FIG. 3.
Figure 5:
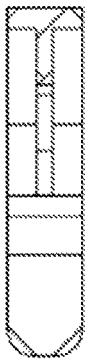
FIG. 5 shows a cross-sectional view of the arch structure along A-A shown in FIG. 3.

FIG. 3 shows a schematic diagram of an arch structure according to a preferred embodiment of the present invention. FIG. 4 shows a bottom view of the arch structure shown in FIG. 3. FIG. 5 shows a cross-sectional view of the arch structure along A-A shown in FIG. 3. Wherein, the arch structure comprises two interface unit 301 respectively located at two sides and four snap-fits 302. From left to right, the first snap-fit 302 is located in front of the projection mid-axis, the second snap-fit 302 is located behind the projection mid-axis, the third snap-fit 302 is located in front of the projection mid-axis, the fourth snap-fit 302 is located behind the projection mid-axis, and the four snap-fits 302 are arranged in a parallelogram structure. Wherein, the interface unit 301 is an I-shaped structure.

Figure 6:
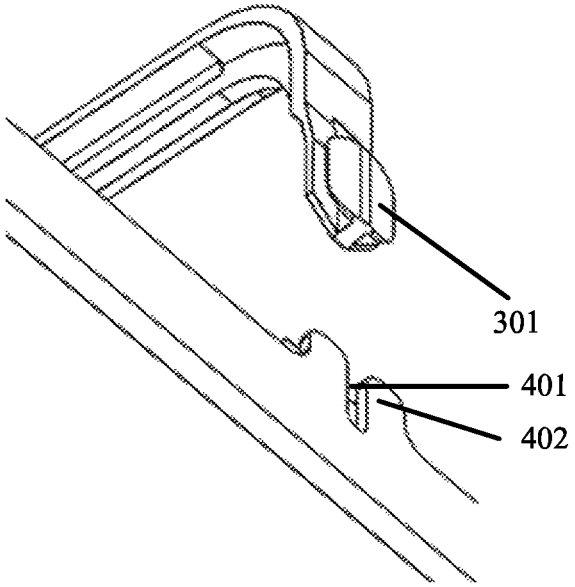
FIG. 6 shows a schematic diagram of the interface unit shown in FIG. 3 during assembly.
Figure 7:
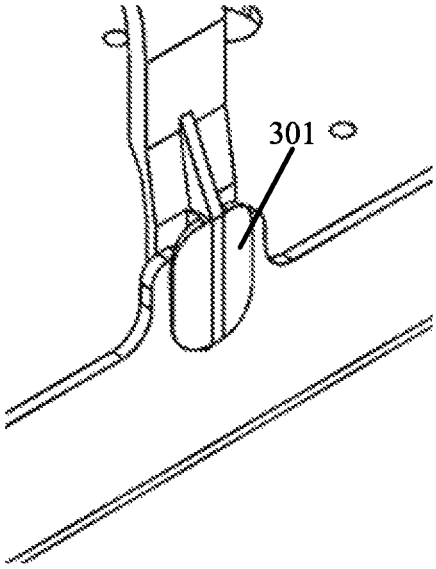
FIG. 7 shows a schematic diagram of the interface unit shown in FIG. 3 after assembly.

FIG. 6 shows a schematic diagram of the interface unit shown in FIG. 3 during assembly, FIG. 7 shows a schematic diagram of the interface unit shown in FIG. 3 after assembly. Wherein, the side edge of the reflector includes a U-shaped groove 401, and two protrusions 402 respectively located at two sides of the U-shaped groove 401. As shown in FIG. 7, after the installation is completed, the rib plat in the interface unit 301 is inserted into the U-shaped groove 401. It should be noted that, the height of the U-shaped groove can be increased by setting the protrusion on both sides of the U-shaped groove, so as to reduce the length of the side of the arch structure and save the manufacturing cost of the arch structure.

Figure 8:
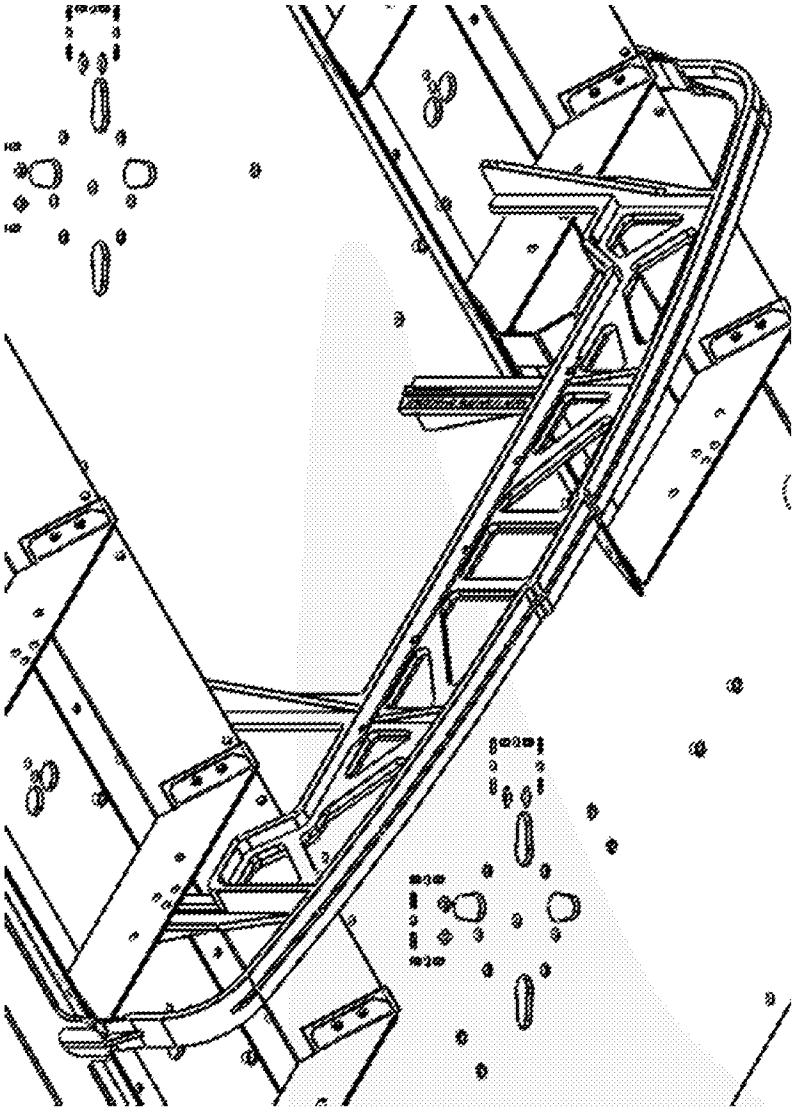
FIG. 8 shows an assembly diagram of the arch structure shown in FIG. 3 and a reflector.

FIG. 8 shows an assembly diagram of the arch structure shown in FIG. 3 and a reflector. It can be seen from FIG. 8, there is no interference between the arch structure and the metal plate on the reflector.

The present invention also provides an arch structure for multi-band base station antenna, the arch structure comprises two interface units for connecting with the side edge of a reflector, and a plurality of snap-fits for fixing with the bottom of the reflector, wherein the interface unit adopts I-shaped structure, and the I-shaped structure matches U-shaped groove on the side edge of the reflector. Wherein, the interface unit has been described in detail above, which will not be detailed here.

According to the arch structure of the present invention, it can effectively avoid the interference between the arch structure and the dipole or dipole isolation wall, and enhance the stability of arch structure since at least two snap-fits in the plurality of snap-fits are not arranged on the projection mid-axis of the arch structure. In addition, because of the enhanced stability of the arch structure, making it possible to reduce the width of the arch structure, and slender structure makes the product weight smaller, thereby reducing production materials and saving manufacturing costs. Taking an arch structure with four snap-fits as an example, compared with the prior art, the arch structure in this invention can save about 46% of the cost, the longer the antenna length is, the more arches are needed, thus the more cost can be saved.

Moreover, it is easier to assemble in the mass production line by designing the interface unit of the arch structure as a I-shaped structure and designing the side edge of the reflector as a U-shaped groove that matches the I-shape structure, it does not need extra rivet to fix reflector, and can reduce assembly time, material cost and labor costs.

To those skilled in the art, it is apparent that the present invention is not limited to the details of the above exemplary embodiments, and the present invention may be implemented with other embodiments without departing from the spirit or basic features of the present invention. Thus, in any way, the embodiments should be regarded as exemplary, not limitative; the scope of the present invention is limited by the appended claims instead of the above description, and all variations intended to fall into the meaning and scope of equivalent elements of the claims should be covered within the present invention. No reference signs in the claims should be regarded as limiting of the involved claims. Besides, it is apparent that the term "comprise" does not exclude other units or steps, and singularity does not exclude plurality. A plurality of units or modules stated in a system claim may also be implemented by a single unit or module through software or hardware. Terms such as the first and the second are used to indicate names, but do not indicate any particular sequence.

The invention claimed is:

1. An arch structure for multi-band base station antenna, the arch structure comprises two interface units for connecting with the side edge of a reflector, and a plurality of snap-fits for fixing with the bottom of the reflector, wherein at least two snap-fits in the plurality of snap-fits are not arranged on a projection mid-axis of the arch structure;

wherein the number of the plurality of snap-fits is not less than 3, and the plurality of snap-fits are arranged in at least two straight lines.

2. The arch structure according to claim 1, wherein the layout of the plurality of snap-fits is a triangular structure.

3. The arch structure according to claim 1, wherein the number of the plurality of snap-fits is not less than 4, the layout of the plurality of snap-fits is a parallelogram or trapezoidal structure.

4. The arch structure according to claim 1, wherein the interface unit adopts an I-shaped structure, and the I-shaped structure matches the U-shaped groove on the side edge of the reflector.

5. An arch structure for multi-band base station antenna, the arch structure comprises two interface units for connecting with the side edge of a reflector, and a plurality of snap-fits for fixing with the bottom of the reflector, wherein the interface unit adopts I-shaped structure, and the I-shaped structure matches U-shaped groove on the side edge of the reflector;

wherein the number of the plurality of snap-fits is not less than 3, and the plurality of snap-fits are arranged in at least two straight lines.

* * * * *